US006186453B1

(12) United States Patent
Redbone

(10) Patent No.: US 6,186,453 B1
(45) Date of Patent: Feb. 13, 2001

(54) FOOT ADJUSTABLE LEVELERS

(76) Inventor: Leon Redbone, Box 438, Lahaska, PA (US) 18931

( * ) Notice: Under 35 U.S.C. 154(b), the term of this patent shall be extended for 0 days.

(21) Appl. No.: 09/311,930

(22) Filed: May 14, 1999

Related U.S. Application Data

(60) Provisional application No. 60/085,388, filed on May 14, 1998.

(51) Int. Cl.[7] ..... A47B 91/02

(52) U.S. Cl. ..... 248/188.4; 248/188.9; 16/42 R

(58) Field of Search ..... 248/188.4, 188.2, 248/650, 649, 188.8, 188.9; 411/229, 210; 16/42 R, 42 T

(56) References Cited

U.S. PATENT DOCUMENTS

| | | | | |
|---|---|---|---|---|
| 630,128 | * | 8/1899 | Stock | 16/42 T |
| 1,208,210 | * | 12/1916 | Purcell et al. . | |
| 1,366,687 | * | 1/1921 | Arndt | 411/299 |
| 1,647,992 | * | 11/1927 | Hartman | 248/188.4 |
| 2,272,848 | * | 2/1942 | Miller | 248/188.4 |
| 2,295,911 | * | 9/1942 | Page | 248/188.4 |
| 2,327,050 | * | 8/1943 | Kotler | 248/188.4 |
| 2,338,092 | * | 1/1944 | Brown | 248/188.4 |
| 2,568,507 | * | 9/1951 | Miller | 16/42 T |
| 3,025,631 | * | 3/1962 | Reynolds | 16/42 T |
| 3,080,601 | * | 3/1963 | Kramcsak, Jr. | 16/421 |
| 3,722,026 | * | 3/1973 | Wilhelmi | 16/421 |
| 5,092,550 | * | 3/1992 | Bettini | 248/188.4 |
| 5,538,378 | * | 7/1996 | Van Der Drift | 411/299 |
| 5,890,696 | * | 4/1999 | Ozawa | 248/188.4 |
| 6,010,289 | * | 1/2000 | Distasio et al. | 411/299 |

FOREIGN PATENT DOCUMENTS

| | | | | |
|---|---|---|---|---|
| 2183769 | * | 6/1987 | (GB) | 411/10 |

* cited by examiner

*Primary Examiner*—Ramon O. Ramirez
*Assistant Examiner*—Jon Szumny
(74) *Attorney, Agent, or Firm*—Law Offices of Royal W. Craig

(57) ABSTRACT

A foot-adjustable leveler comprising a threaded bolt for upward insertion into a table leg, and a foot anchored to the bolt. The foot may be formed from a thin metal jacket that is stamped or pressed onto a hard rubber insert. In this case the bolt is equipped with a flange at one end and is suspended thereby centrally within the hard rubber insert. This serves to reduce vibration and noise transfer. The internal rubber insert is optional, and the bolt can be anchored directly to the metal exterior of the foot jacket. In either case, a rubber foot-adjustment disk is centered on the bolt and is seated on the upper surface of the stamped metal foot. A user simply turns the foot-adjustment disk counter-clockwise with the side of their shoe sole in order to raise the table leg, and clockwise to lower the leg. Other embodiments are presented, including one in which the rubber insert and foot-adjustment disk are combined into one integral foot-adjustment member. Alternatively, a rubber collar is provided around the bottom of the bolt and is seated atop the stamped metal foot jacket. A foot-adjustment ring encircles the rubber collar and is anchored thereto. A user simply turns the foot-adjustment ring counterclockwise with the side of their shoe sole in order to raise the table leg, and clockwise to lower the leg. Alternatively, a concave disk overlay may be slid down over the collar, and a the foot-adjustment ring may be inset around the periphery of the disk overlay.

A safety accessory is also provided for use in preventing over-extension of the leveler. The safety accessory includes a spiral notch cut along a length of the bolt threads, and a safety disk with spring-detent that engages the notch to stop further unscrewing.

4 Claims, 6 Drawing Sheets

FOOT ADJUSTABLE LEVELERS

CROSS-REFERENCE TO RELATED APPLICATIONS

The present application is based on Provisional Application No. 60/085,388, filed on May 14, 1998.

BACKGROUND OF THE INVENTION

1. Field of the Invention

The present invention relates to levelers for tables and the like and, more particularly, to an improved table leveler which, when installed on the legs of a table, allows convenient foot-actuated adjustment to compensate for uneven floors.

2. Description of the Background

Many tables have a seemingly ever-present wobble that causes constant irritation. Such wobbling generally results from equal table legs on an uneven floor. Although the problem may be fixed by inserting skids beneath the short leg(s), this is only a temporary solution and usually requires a prolonged search for a makeshift skid of the proper size. There are prior art levelers for tables and the like. These typically include a simple metal foot with extending bolts that can be inserted into the bottom of each leg to an adjustable depth. These are common items and are readily available. However, in all known variations the metal feet have a fairly small diameter and cannot easily be rotated by hand (especially if bearing the weight of the table). Some do come equipped with a hex collar to allow rotation by a hex wrench. Unfortunately, use of a hex wrench is not always convenient, especially in a setting such as a restaurant. In this context, there are a multitude of tables which regularly need adjustment. Neither restauranteurs or their customers want to be seen on their hands and knees.

Accordingly, it would be a great advantage to provide a leveler for allowing quick and easy adjustment of table legs and the like by manipulation with the feet.

SUMMARY OF THE INVENTION

It is, therefore, an object of the present invention to provide a leveler for allowing quick and easy adjustment of table legs and the like by manipulation with the feet.

It is a further object to allow adjustment of an uneven table without risk of upsetting any items on the table.

It is still another object to provide a means for adjustment of table height by slight and simple rotation of the leveler with the sole edge of one's shoe.

It is another object to provide a leveler as described above which is simple yet innovative in design and which lends itself to economical manufacture and assembly.

According to the present invention, the above-described and other objects are accomplished by providing various embodiments of a foot-adjustable leveler comprising a threaded bolt for upward insertion into a table leg, and a foot anchored to the bolt. In accordance with the invention, the foot comprises a hard rubber disc which is enveloped by a thin metal jacket. The metal jacket is stamped or pressed onto the rubber disc. The bolt is equipped with a flange at one end and is suspended thereby centrally within the hard rubber disc. This serves to reduce vibration and noise transfer. The internal rubber disc is optional, and the bolt can be anchored directly to the metal exterior of the foot jacket. In either case, a rubber foot-adjustment disk is centered on the bolt and is seated on the upper surface of the stamped metal foot. A user simply turns the foot-adjustment disk counterclockwise with the side of their shoe sole in order to unscrew the bolt and raise the table leg. Conversely, the foot-adjustment disk is turned clockwise to screw the bolt and lower the leg. Other embodiments are presented, including one in which the rubber insert and foot-adjustment disk are combined into one integral foot-adjustment member. Alternatively, a rubber collar may be provided around the bottom of the bolt and is seated atop the stamped metal foot jacket. A foot-adjustment ring encircles the rubber collar and is anchored thereto. Again, a user simply turns the foot-adjustment disk counterclockwise with the side of their shoe sole in order to unscrew the bolt and raise the table leg. Conversely, the foot-adjustment disk is turned clockwise to screw the bolt and lower the leg. Alternatively, a concave disk overlay may be seated atop the collar and slid down over, and the foot-adjustment ring may be inset into the disk overlay.

In addition, a safety accessory is provided for use in preventing over-extension of the leveler. The safety accessory includes a spiral notch cut along a length of the bolt threads, and a safety disk with spring-detent that engages the notch to stop further unscrewing.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
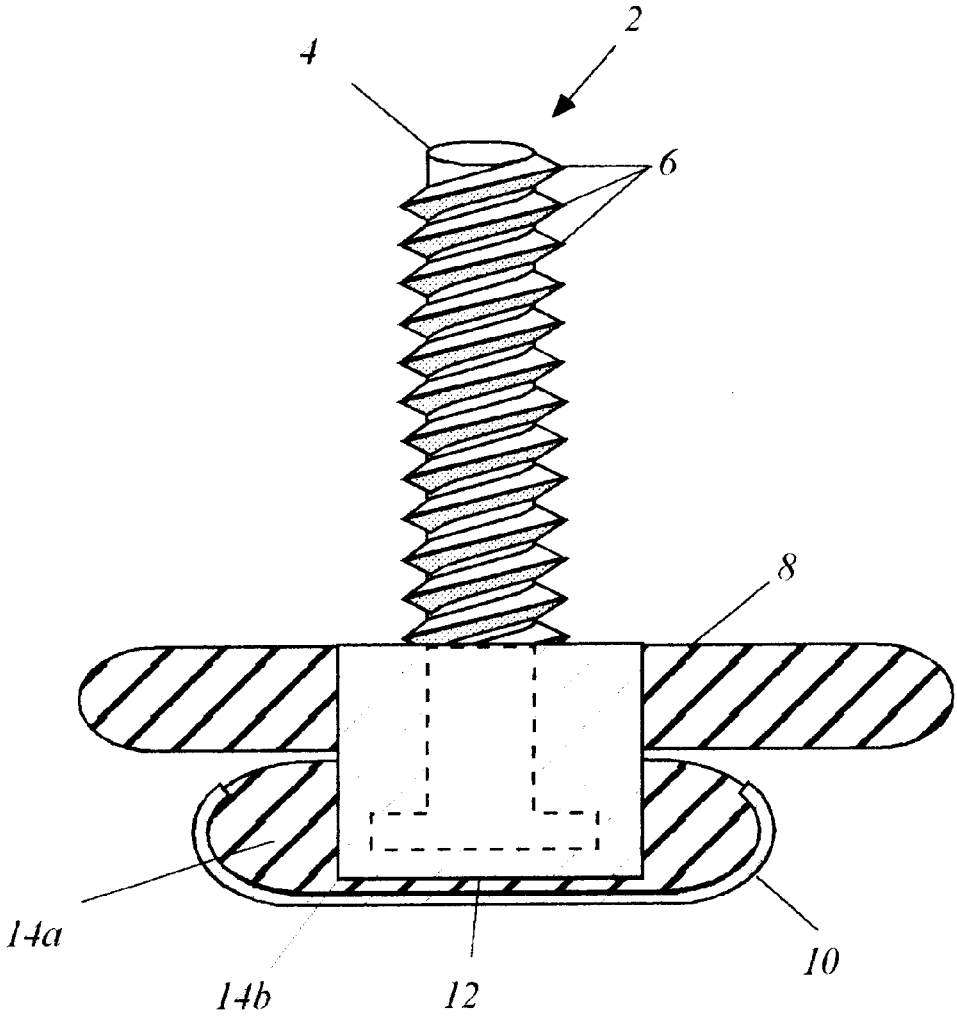
FIG. 1 is a front cut-away view of leveler 2 according to one embodiment of the present invention.

FIG. 1 illustrates a front cut-away view of a foot-adjustable leveler 2 in accordance with one embodiment of the present invention.

As do many conventional levelers, the illustrated leveler generally comprises a threaded bolt 4 for upward insertion into a table leg, and a foot.

The typical bolt 4 is about one inch long, bears a 1/4/20 thread, (or ¼-20, signifying ¼" per 20 turns), and terminates at a flange 12 (the present invention includes but is not limited to a bolt of these dimensions).

In the prior art, the protruding flange 12 of bolt 4 would be welded or otherwise anchored at a 90 degree angle within the center of rubber disc 14.

In accordance with the present invention, the foot comprises a hard rubber insert 14*a* which is enveloped by a thin metal jacket 10. The metal jacket 10 is stamped or pressed onto the rubber insert 14*a*. Rather than welding, the flange 12 of bolt 4 is suspended centrally within the hard rubber insert 14*a*, and this serves to reduce vibration and noise transfer. Of course, the internal rubber insert 14*a* may be omitted, in which case the bolt flange 12 can be anchored directly to the metal exterior of the foot jacket 10.

A foot-adjustment disk 8 is centered on the bolt 4 and is seated against the top surface of the stamped metal foot jacket 10. The foot-adjustment disk 8 is preferably either bonded or integrally attached (as shown) to insert 14*a*. Foot-adjustment disk 8 should be approximately two (2) inches in diameter by ¼ inch in height assuming a bolt 4 and foot jacket 10 of standard dimensions as described above. The outer periphery of foot-adjustment disk 8 is preferably composed of soft rubber, e.g., having a suitable Durometer rating preferably in the 60–70 range. This promotes adequate friction when contacted by the sole of one's shoe. While it is possible to construct the entire foot-adjustment disk 8 (including insert 14*a*) of a uniform soft rubber, it should be understood that the end of bolt 4 floats therein. To better anchor bolt 4 and to increase structural rigidity thereabout, it is desirable to reinforce the soft rubber with a harder insert 14*b* (as shown). Insert 14*b* may be composed of a harder rubber, plastic, or any other suitable anchoring material. It is also fairly important to insure that the height of the foot-adjustment disk 8 corresponds to the height of typical shoe soles to insure the user does not have to elevate his foot to turn the disk 8. The one-quarter-inch disk 8 seated atop a maximum ⅜-inch foot jacket 10 serves well in most all cases.

In operation, a user simply turns the foot-adjustment disk 8 counterclockwise with the side of their shoe sole in order to unscrew the bolt 4 and raise the table leg. Conversely, the foot-adjustment disk 8 is turned clockwise to screw the bolt 4 and lower the leg.

Figure 2:
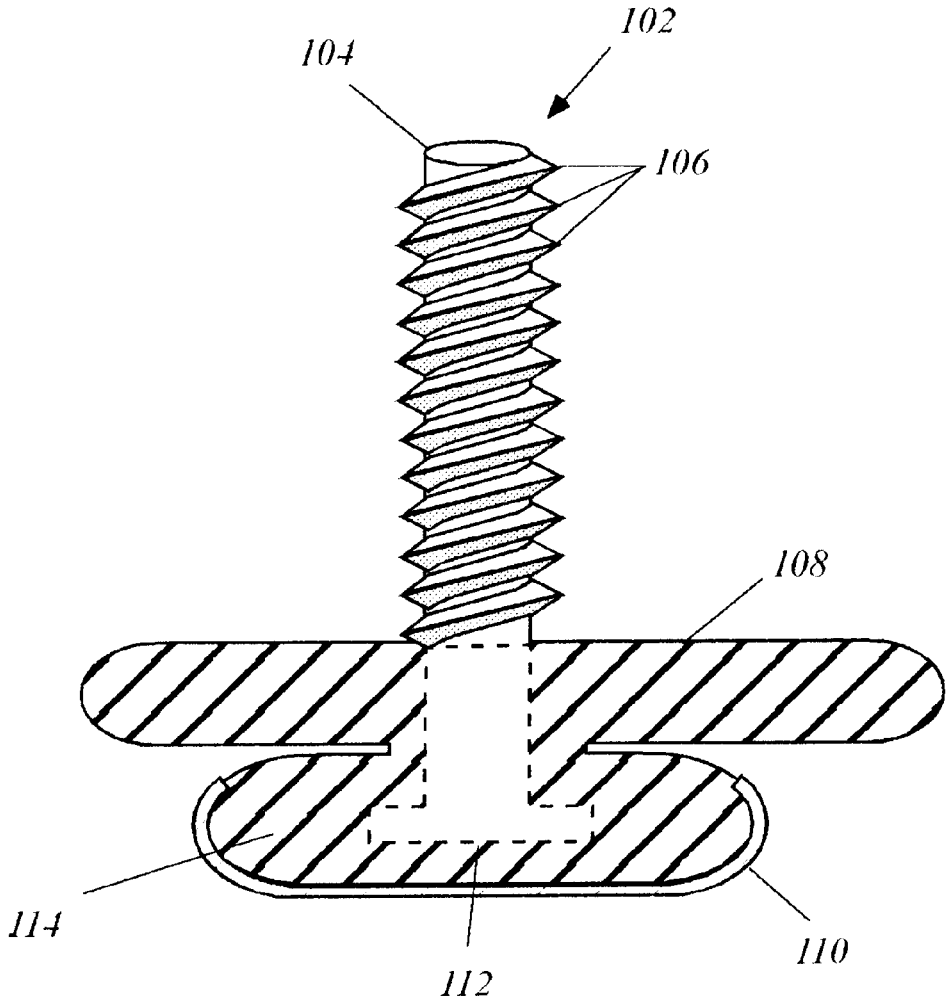
FIG. 2 is a front cut-away view of a leveler 102 according to a second embodiment of the present invention.

FIG. 2 illustrates a front cut-away view of a foot-adjustable leveler 102 in accordance with a second embodiment of the present invention.

In this second embodiment the hard rubber insert 14*b* of FIG. 1 is eliminated, and the foot-adjustment disk 8 and insert 14*a* are combined into one integral foot-adjustment member 114. Otherwise, all dimensions remain the same and the entire foot-adjustment member disk 114 may be composed of the same soft rubber with suitable Durometer rating, again preferably in the 60–70 range.

Figure 3:
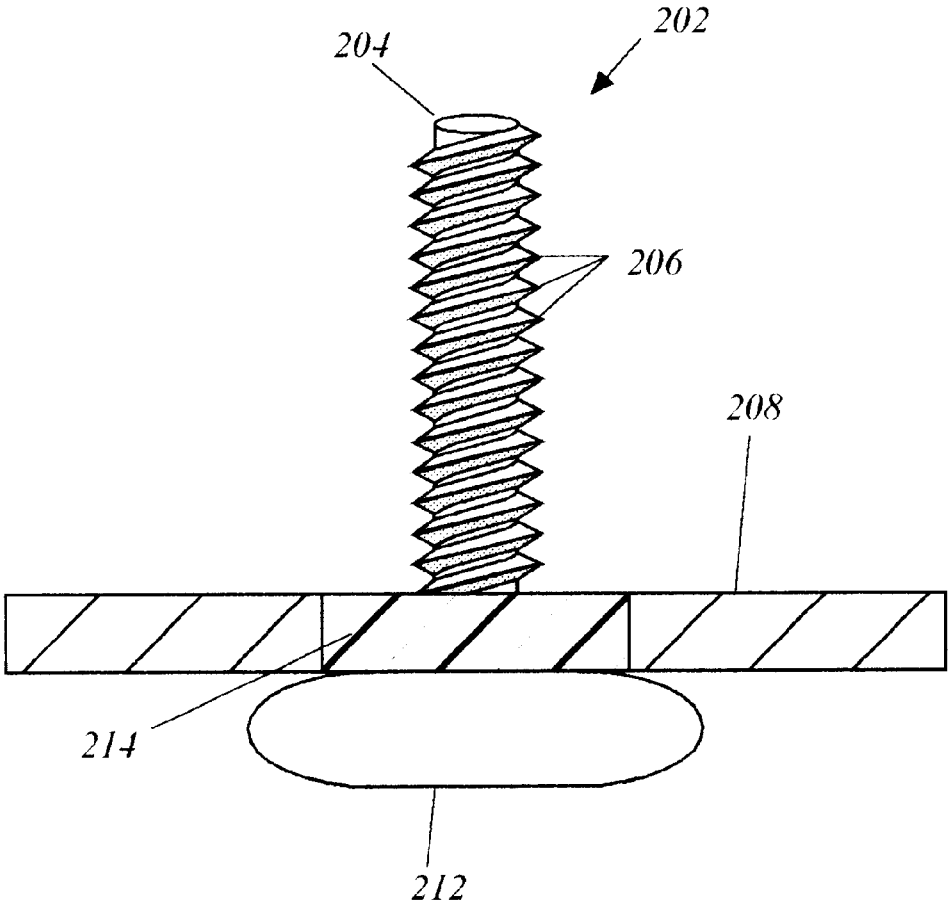
FIG. 3 is a front cut-away view of a leveler 202 according to a third embodiment of the present invention.

FIG. 3 is a front cut-away view of a leveler 202 according to a third embodiment of the present invention. In FIG. 3 a rubber collar 214 is provided around the bottom of bolt 204 and seated atop the stamped metal foot jacket 212. The rubber collar should be hard rubber for rigid support of the threaded bolt 206. As before, metal foot jacket 212 may be stamped or pressed onto a rubber (not shown) insert, foot-adjustment ring 208 encircles the rubber collar 214 and is anchored thereto. Foot-adjustment ring 208 is preferably approximately two (2) inches in diameter by ¼ inch in height (assuming a bolt 204 and foot jacket 212 of standard dimensions as described above). The entire foot-adjustment ring 208 is composed of soft rubber with a suitable Durometer rating, again preferably in the 60–70 range. As before, a user simply turns the foot-adjustment ring 208 counterclockwise with the side of their shoe sole in order to unscrew the bolt 204 and raise the leg. Conversely, the foot-adjustment ring 208 is turned clockwise to screw the bolt 204 and lower the leg.

Figure 4:
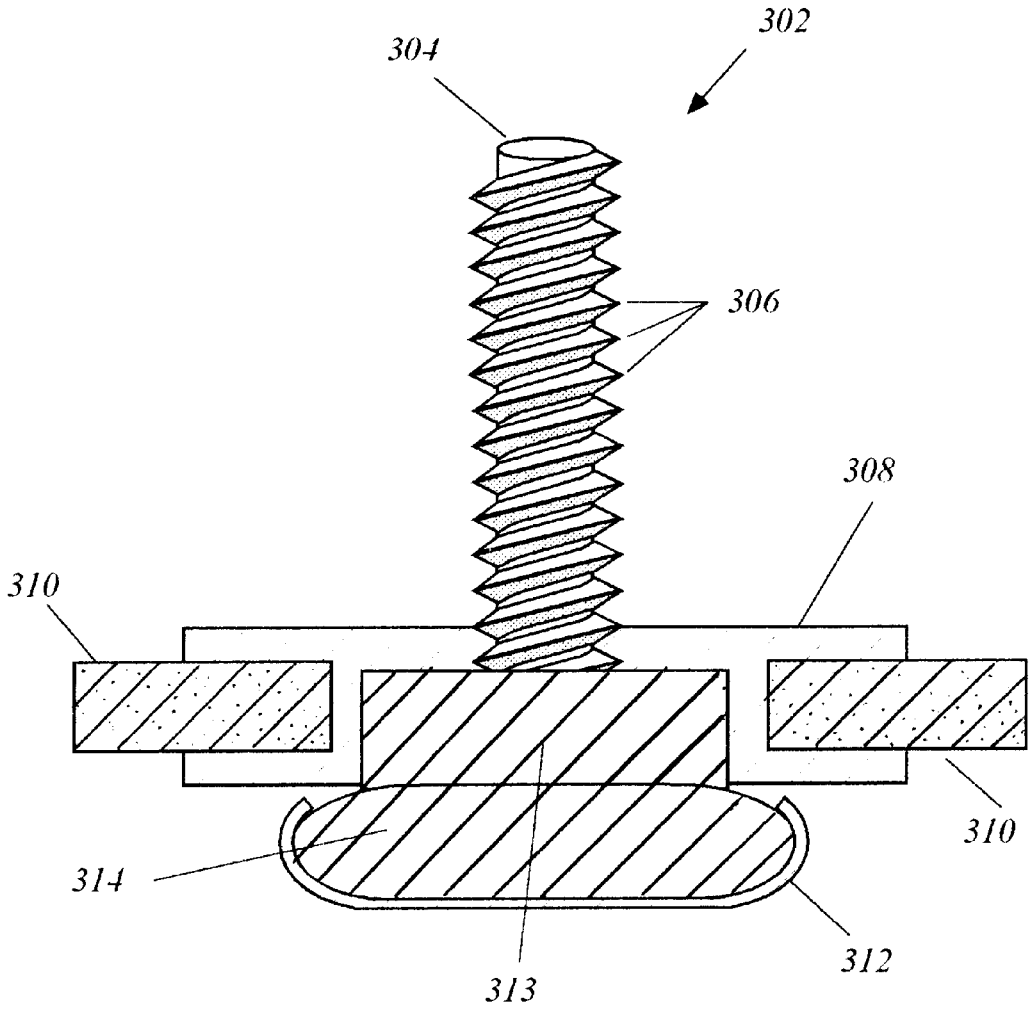
FIG. 4 is a front cut-away view of a leveler 302 according to a fourth embodiment of the present invention.

FIG. 4 is a front cut-away view of a leveler 302 according to a fourth embodiment of the present invention. In FIG. 4 a rubber collar 313 (similar to collar 214 of FIG. 3) is provided around the bottom of a like bolt 304 and is seated atop an identical stamped metal foot jacket 312. As before, metal jacket 312 may be stamped or pressed onto a rubber insert 314. Insert 314 and collar 313 are preferably formed of the same hard rubber material and these two components may be provided as one integral part. A concave metallic disk overlay 308 is seated atop collar 313 and slides down from overhead. The periphery of metal disk overlay 308 is defined by a circular channel, and a rubber foot-adjustment ring 310 is inset in the channel of disk overlay 308 and remains anchored therein. Foot-adjustment ring 310 is again approximately two (2) inches in diameter by ¼ inch in height assuming a bolt 304 and foot 312 of standard dimensions as described above. The foot-adjustment ring 310 is composed of rubber having a softer Durometer rating preferably in the 60–70 range. As before, a user simply turns the foot-adjustment ring 310 counterclockwise with the side of their shoe sole in order to unscrew the bolt 304 and raise the table leg. Conversely, the foot-adjustment ring 310 is turned clockwise to screw the bolt 304 and lower the leg.

Figure 5:
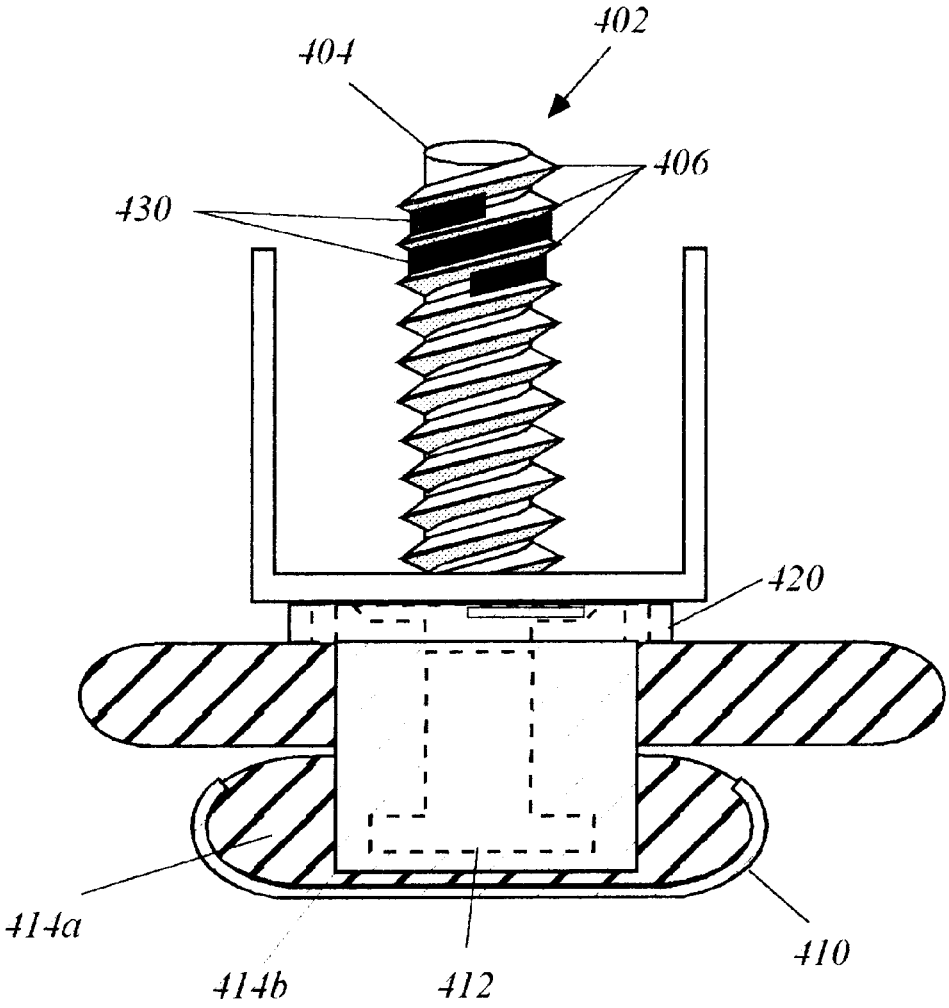
FIG. 5 is a front cut-away view of a safety accessory for use in preventing over-extension of leveler 402 or any of the other leveler embodiments disclosed herein.

FIG. 5 is a front cut-away view of a safety accessory for use in preventing over-extension of a leveler 402 (similar to that shown in FIG. 2), or any of the other levelers disclosed herein. The safety accessory includes a spiral notch 430 which is cut along a length of the threads 406 near the top of bolt 404. Spiral notch 430 runs deeper than said threads and is a substantially cut between opposing threads 406. The vertical position of notch 430 along bolt 404 corresponds to the maximum desired extension of bolt 404. The notch 430 works with safety disk 420 to stop further unscrewing.

Figure 6:
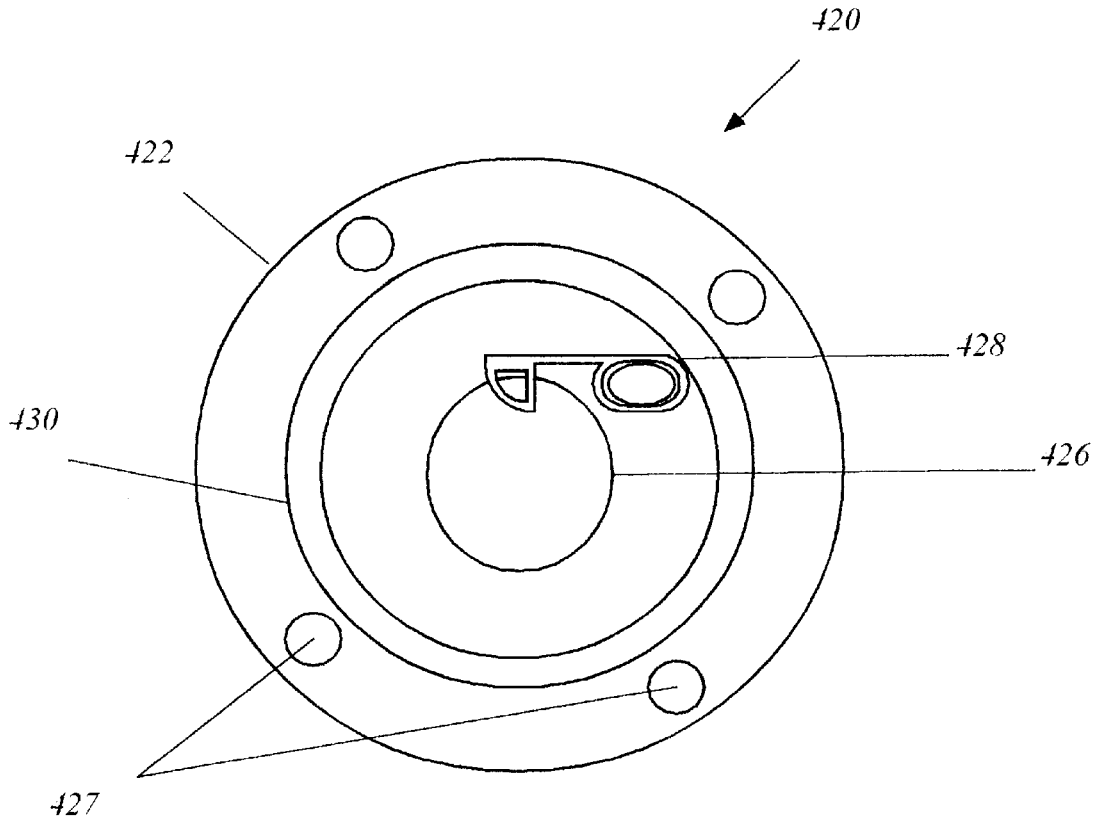
FIG. 6 is a top view of the safety device 420 as shown in FIG. 5.

FIG. 6 is a top view of the safety disk 420 as shown in FIG. 5. Safety disk 420 is a simple circular disk having a concave recess 426 in the middle. The periphery of safety disk 420 is defined by a plurality of bore-holes 427 so that disk 420 can be screw-anchored to the bottom of a table leg (as shown in FIG. 5). A spring detent 428 is mounted within the recess on an off-set post or the like, and spring detent 428 is extended toward one side of recess 426 at the center of disk 420. The extended end of detent 428 is formed in a tooth configuration with one the outer surface being ramped and the inner surface being substantially right-angled with respect to the axis of disk 420. In operation, the toothed end of detent 428 is free to enter the spiral notch 430 in bolt 404 as the bolt is being extended (by counter-clockwise rotation). However, when the detent 428 reaches the far end of notch 430 the right-angled surface of the tooth becomes engaged therein and prevents further counter-clockwise rotation. This avoids over-extension of the leveler. On the other hand, the leveler can be shortened by clockwise rotation as the ramped surface of the toothed end of detent 428 will not engage.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

I claim:

1. An adjustable foot leveler adapted to attach to a table leg, comprising:

a threaded bolt for upward insertion into a table leg, a foot fixedly attached to one end of said threaded bolt, said foot further comprising a foot jacket partially enclosing a foot insert, and a shoe-operable adjustment disk, fixedly attached to said foot insert and spaced from said foot jacket and extending radially outward from said threaded bolt and beyond said foot insert to allow height-adjustment of said table leg using the sole of one's shoe.

2. The adjustable foot leveler of claim 1, further comprising a spiral notch formed in a second end of said threaded bolt, and a safety disk adapted for fixed attachment to said table leg having a spring detent for engaging said spiral notch.

3. An adjustable foot leveler adapted to attach to a table leg, comprising:

a threaded bolt for upward insertion into a table leg, a foot jacket, and a shoe-operable adjustment means, fixedly attached to said threaded bolt, wherein said foot adjustment means further comprises a foot insert portion fixedly attached to said foot jacket and fixedly attached to said threaded bolt, and a foot adjustment disk portion spaced from said foot jacket, wherein said foot adjustment disk portion extends radially outward from said threaded bolt and beyond said foot insert portion to allow height-adjustment of said table leg using a sole of one's shoe.

4. The adjustable foot leveler of claim 3, further comprising a spiral notch formed in a second end of said threaded bolt, and a safety disk adapted for fixed attachment to said table leg having a spring detent for engaging said spiral notch.

* * * * *